United States Patent [19]

Harley

[11] Patent Number: 4,686,714

[45] Date of Patent: Aug. 18, 1987

[54] REVERSIBLE DRESS

[76] Inventor: Vida A. Harley, 409 E. Haney, South Bend, Ind. 46613

[21] Appl. No.: 724,064

[22] Filed: Apr. 17, 1985

[51] Int. Cl.[4] ..... A41D 1/22; A41B 9/00

[52] U.S. Cl. ..... 2/105; 2/74; 2/114

[58] Field of Search ..... 2/74, 105, DIG. 2, 69, 2/114

[56] References Cited

U.S. PATENT DOCUMENTS 601,434 3/1898 Davis ..... 2/DIG. 2

2,425,402 8/1947 Sieloft ..... 2/DIG. 2

FOREIGN PATENT DOCUMENTS 744888 10/1966 Canada ..... 2/DIG. 2

*Primary Examiner*—Doris L. Troutman

*Attorney, Agent, or Firm*—Thomas J. Dodd; James D. Hall

[57] ABSTRACT

A dress formed of two sheets of material joined in a back to back relationship. Each sheet has a differential design or color combination and is joinable at one side edge and the top which allows several styles to be attained for the dress. A series of side and top edge closures secures the dress in each of its selected positions.

2 Claims, 8 Drawing Figures

REVERSIBLE DRESS

SUMMARY OF THE INVENTION

This invention relates to a dress, and will have special application to a reversible dress having two or more distinct designs.

The dress of this invention includes two sheets of fabric material positioned back to back. Each sheet is preferably of a different color or carries a distinct design, and a series of closures allows the dress to be reversed and secured in any of three or more selected styles to produce a truly distinct look with one garment.

Accordingly, it is an object of this invention to provide for a novel reversible dress.

Another object of this invention is to provide a dress which is economical and is capable of producing several distinct looks.

Other objects of this invention will become apparent upon a reading of the following description.

BRIEF DESCRIPTION OF THE DRAWINGS

A preferred embodiment of the invention has been depicted for purposes of illustration wherein.

DESCRIPTION OF THE PREFERRED EMBODIMENT

Figure 1:
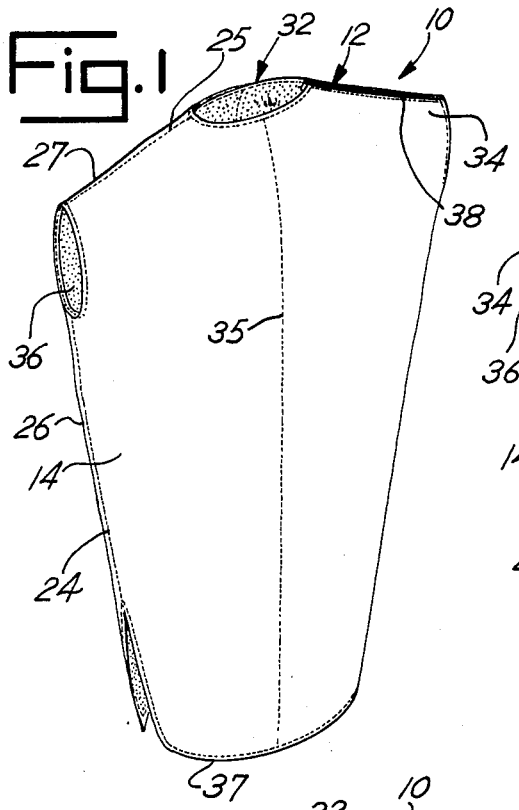
FIG. 1 is a front perspective view of the dress in a first style.

The preferred embodiment herein described is not intended to be exhaustive or to limit the invention to the precise form disclosed. It is chosen and described to explain the principles of the invention and its application and practical use to enable others skilled in the art to utilize the invention.

The dress 10 shown in the drawings includes a sheet 12 of fabric material, which has a front face 14 and a rear face 16, and a sheet 18 of fabric material, which has a front face 20 and a rear face 22. Sheets 12 and 18 preferably are of distinct colors or designs as shown and are secured in a rear face to rear face relationship by stitching 24 at their corresponding vertical end edges 26 and by stitching 25 at their corresponding top edges 27 with sheet front faces 14 and 20 exposed.

Sheets 12 and 18 are also stitched at 28, 30 to define a central opening 32 for the head and neck of the dress wearer. Additionally, sheets 12 and 18 are joined by vertical stitching 35 extending between bottom edge 37 and top edge 27 of the sheets at each side of neck opening 32. A shoulder portion 34 extends forwardly from each side of opening 32 and includes an arm opening 36. A closure, such as zipper 38, detachably connects top edges 27 of sheet 12 and a closure, such as zipper 40, detachably connects side edge 26 of the sheet.

Figure 2:
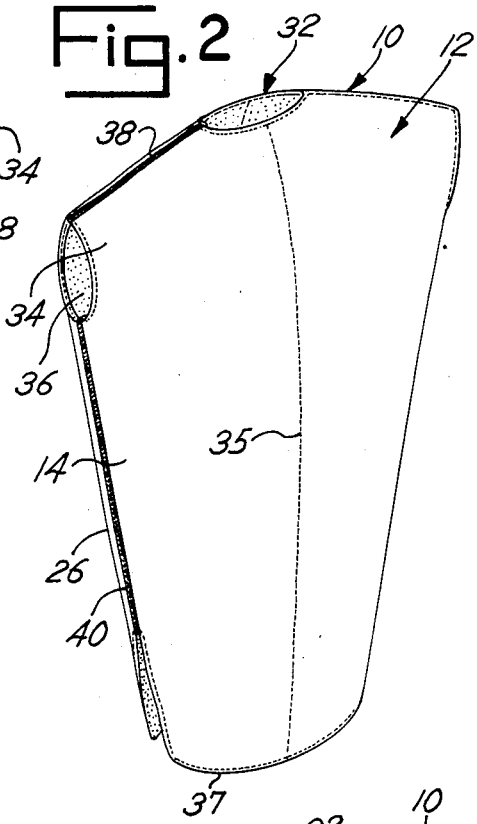
FIG. 2 is a rear perspective view of the dress in its first style.
Figure 3:
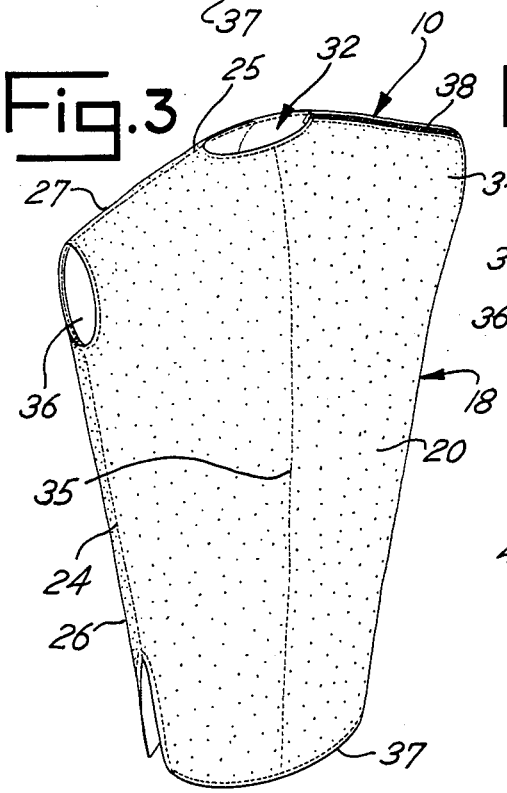
FIG. 3 is a front perspective view of the dress in a second style.
Figure 4:
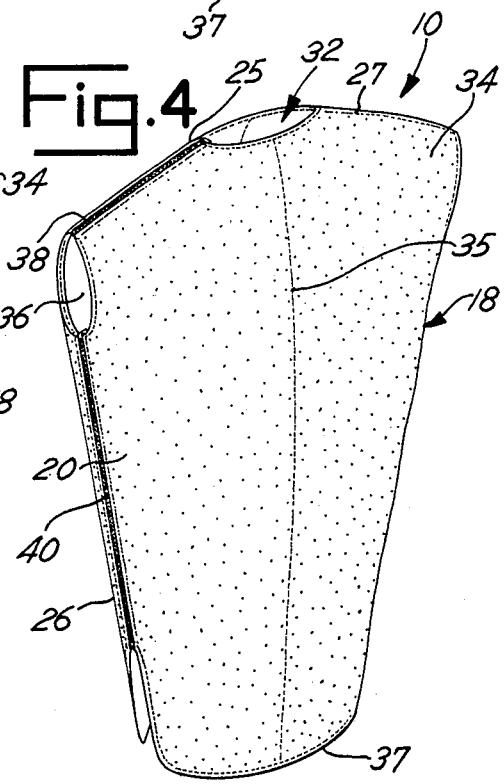
FIG. 4 is a rear perspective view of the dress in its second style.
Figure 5:
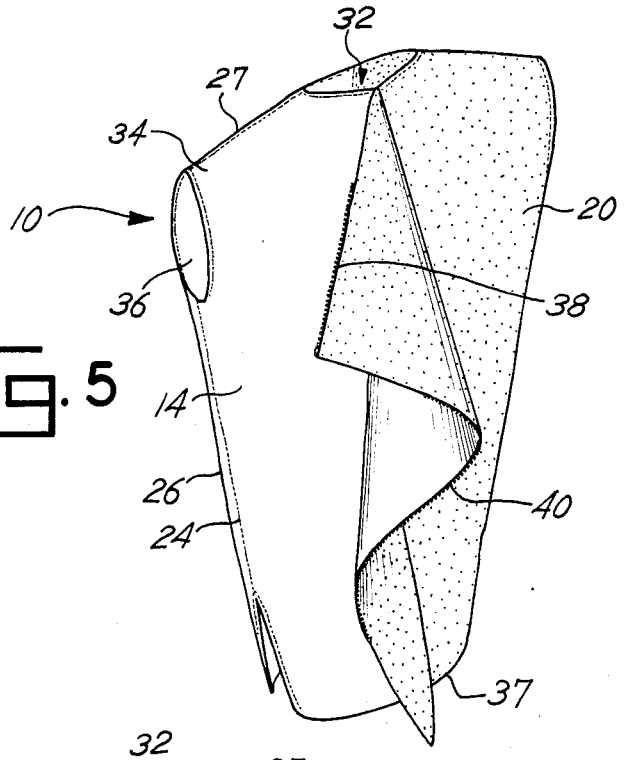
FIG. 5 is front perspective view of the dress in a third style.
Figure 6:
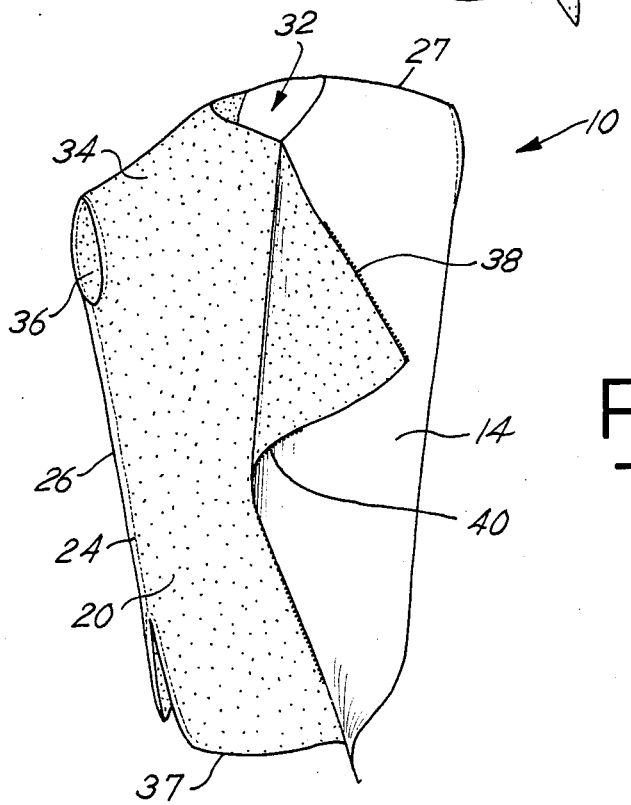
FIG. 6 is a rear perspective view of the dress in its third style.
Figure 7:
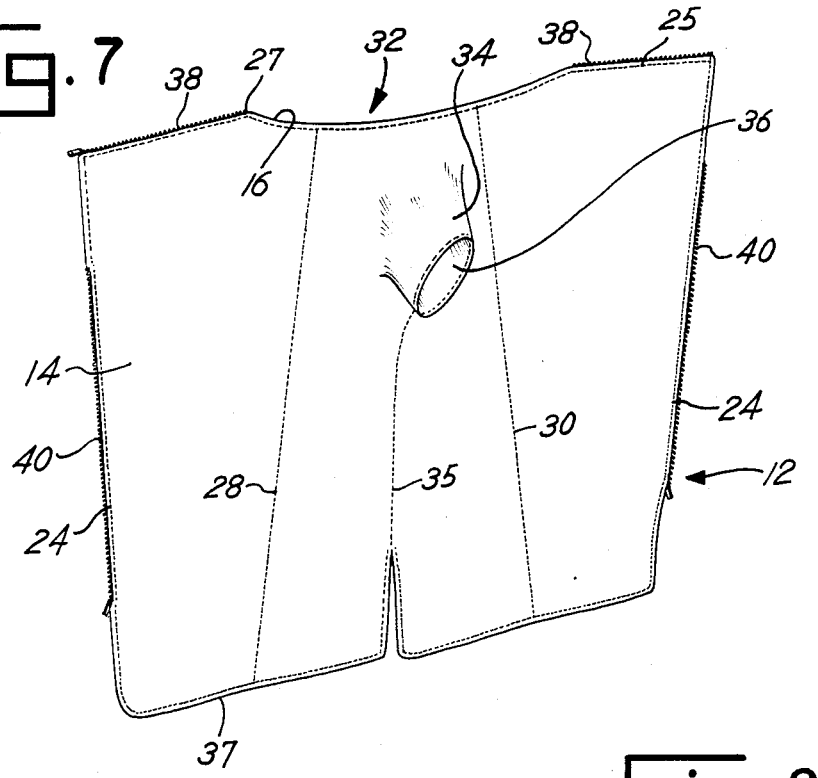
FIG. 7 is a top front perspective view of the dress in an open style.
Figure 8:
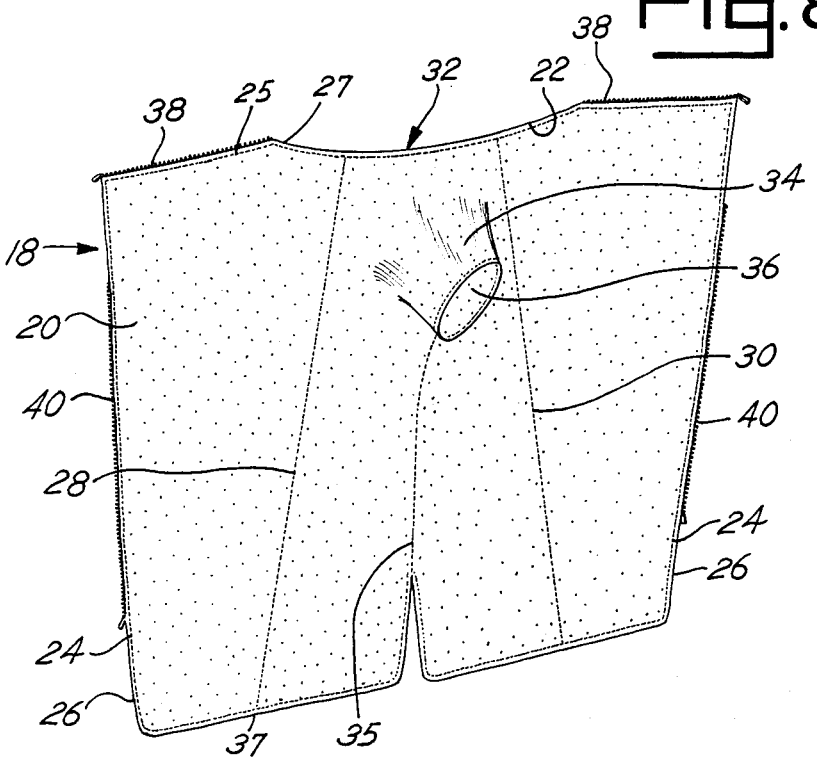
FIG. 8 is a top rear perspective view of the dress in an open style.

Dress 10 may be worn as shown in FIGS. 1–6. In FIGS. 1 and 2 dress 10 has been folded about stitching 28 to fully expose only front face 14 of sheet 12. Zipper 40 is closed along sheet side edge 26 and zipper 38 is closed along sheet top edge 27 at one side of the dress over the adjacent arm opening 36 to secure the dress 10 in one style. FIGS. 3 and 4 depict the dress folded to fully expose only front face 20 of sheet 18 with zippers 38 and 40 being closed at sheet edge 26 and along sheet edge 27 at the opposite side of the dress overlying the adjacent arm opening 36. As shown in FIGS. 5 and 6, a third style of dress 10 may be achieved by opening zipper 38 to expose portions of both front faces 14, 20 of sheets 12 and 18.

It is understood that the invention is not limited to scope of the above given details but may be modified within the scope of the appended claims.

I claim:

1. A dress comprising first and second fabric sheets, each sheet having a front face and a rear face, said sheets positioned in a rear to rear face relationship to form common top and bottom edges and two common vertical end edges, each sheet including a shoulder portion extending forwardly of its said front face, each shoulder portion including an arm opening, said shoulder portions being separated to form a central opening means between said sheets for accommodating the head and neck of a wearer, said sheets joined at one said common end edges and said top edges, said sheets joined adjacent each side of said central opening means from said top edges to said bottom edges, said dress having a first style wherein said first sheet front face is exposed at the front and rear of the wearer and a second style wherein said second sheet front face is exposed at the front and rear of the wearer and a third style wherein a portion of each sheet front face is exposed at the front and rear of the wearer, first connectable closure means attached to each sheet end edge for securing said dress in a selected one of its said three styles, and second connectable closure mens attached to said sheet top edge for securing said dress in a selected one of its first and second styles.

2. The dress of claim 1 wherein said second closure means overlies one of said shoulder portions when connected in either of said first and second styles.

* * * * *